US006651470B1

(12) United States Patent
Rafter

(10) Patent No.: US 6,651,470 B1
(45) Date of Patent: Nov. 25, 2003

(54) SYSTEM FOR ORNAMENTING A KEY

(76) Inventor: W. Michael Rafter, P.O. Box 372 Santa Fe, Santa Fe, NM (US) 87504

( * ) Notice: Subject to any disclaimer, the term of this patent is extended or adjusted under 35 U.S.C. 154(b) by 0 days.

(21) Appl. No.: 09/724,831

(22) Filed: Nov. 28, 2000

Related U.S. Application Data

(63) Continuation-in-part of application No. 09/398,336, filed on Sep. 17, 1999, now abandoned.

(51) Int. Cl.[7] ..... E05B 19/04
(52) U.S. Cl. ..... 70/395; 70/408
(58) Field of Search ..... 70/395, 408, 460, 70/411, 412, 456 R, 459

(56) References Cited

U.S. PATENT DOCUMENTS

| | | | | | |
|---|---|---|---|---|---|
| 1,851,986 | A | * | 4/1932 | Rubsamen | 70/491 |
| 2,176,465 | A | * | 10/1939 | Merkl | 70/436 |
| 2,795,128 | A | * | 6/1957 | Ly | 70/456 R |
| 3,349,589 | A | * | 10/1967 | Fricke | 70/395 |
| 3,420,078 | A | * | 1/1969 | Nielsen | 70/456 R |
| 3,729,965 | A | * | 5/1973 | Gartner | 70/395 |
| 3,797,291 | A | * | 3/1974 | Simorghi | 70/395 |
| 3,950,973 | A | * | 4/1976 | Grasnianski | 70/395 |
| 3,955,725 | A | * | 5/1976 | Rese | 70/460 X |
| 4,102,166 | A | * | 7/1978 | Hughes | 70/408 X |
| 4,251,173 | A | * | 2/1981 | Saucedo | 409/82 |
| 4,276,582 | A | * | 6/1981 | Burnett | 362/116 |
| 4,292,995 | A | * | 10/1981 | Mazzola | 70/408 X |
| 4,305,267 | A | * | 12/1981 | Nish et al. | 70/395 |
| 4,336,701 | A | * | 6/1982 | Raymond | 70/395 |
| 4,349,975 | A | * | 9/1982 | Chubb | 40/330 |
| 4,562,712 | A | * | 1/1986 | Wolter | 70/408 X |
| 4,631,943 | A | * | 12/1986 | Hoener | 70/395 |
| 4,901,548 | A | * | 2/1990 | Deslandes | 70/408 |
| 5,058,465 | A | * | 10/1991 | Womack | 81/487 |
| 5,207,082 | A | * | 5/1993 | LeMaitre | 70/408 |
| 5,244,321 | A | * | 9/1993 | Sopko | 409/82 |
| 5,307,658 | A | * | 5/1994 | Kokubu et al. | 70/408 X |
| 5,311,757 | A | * | 5/1994 | Spahn | 70/460 X |
| 5,383,345 | A | * | 1/1995 | Kallinger-Prskawetz-Jacobsen | 70/408 X |
| 5,456,095 | A | * | 10/1995 | Tawil et al. | 63/29.1 |
| 5,477,714 | A | * | 12/1995 | Bishop | 70/459 |
| 5,577,403 | A | * | 11/1996 | Steeley | 70/460 X |
| 5,607,267 | A | * | 3/1997 | Heredia et al. | 409/81 |
| 5,706,683 | A | * | 1/1998 | Napier | 70/395 X |
| 5,711,643 | A | * | 1/1998 | Parr et al. | 409/83 |
| 5,819,568 | A | * | 10/1998 | Christie et al. | 70/395 |
| 5,832,761 | A | * | 11/1998 | Chen | 70/395 |
| 6,164,102 | A | * | 12/2000 | Gapco | 70/408 |

FOREIGN PATENT DOCUMENTS

| | | | | |
|---|---|---|---|---|
| CH | 188571 | * | 4/1937 | 70/395 |
| DE | 3533422 | * | 4/1987 | 70/395 |
| FR | 1425414 | * | 12/1965 | 70/408 |
| FR | 2448607 | * | 10/1980 | 70/408 |
| FR | 2577267 | * | 8/1986 | 70/408 |

* cited by examiner

*Primary Examiner*—Lloyd A. Gall
(74) *Attorney, Agent, or Firm*—Law Office of Ray R. Regan, P.A.

(57) ABSTRACT

A system for ornamenting a key. The system for ornamenting a key according to the present invention includes a casing. One or more threaded rods with casing are provided for securing a key or key blank within the casing. In an alternative embodiment, a bore, a notch, and a tray formed with a neck for securing a key or key blank using one or more threaded rods is provided. The casing itself may be ornamented, and the securing a key or key blank within the casing also may be ornamented. The key is removably securable within the casing.

6 Claims, 5 Drawing Sheets

SYSTEM FOR ORNAMENTING A KEY

CROSS-REFERENCE TO RELATED APPLICATION

As provided in 35 U.S.C. §119, applicant claims priority to this continuation-in-part patent application based on the copending United States patent application filed by Michael Rafter, the sole inventor, also known as W. Michael Rafter, named in this application, filed in the United States Patent and Trademark Office on Sep. 17, 1999, application Ser. No. 09/398,336, since abandoned.

FIELD OF THE INVENTION

The present invention pertains generally to the field of locks and keys. More particularly, the new and useful invention claimed in this document pertains to a system for ornamenting a key. The present invention is particularly, but not exclusively, useful for encasing a key blank within an ornamental casing having any shape or configuration.

BACKGROUND OF THE INVENTION

The lock, a mechanical device for securing a door or receptacle originated in the Near East. Possibly 4,000 years old, a lock of the type known as a pin tumbler originated in Egypt. A pin tumbler lock of those days consisted of a large wooden bolt to secure a door, through which a slot with several holes was formed in the upper surface. An assembly attached to the door contained several wooden pins positioned to drop into the holes and grip the bolt. In that early embodiment, the key was a large wooden bar, something like a toothbrush in shape; instead of bristles it had upright pegs matching the holes and the pins. Inserted in the large keyhole below the vertical pins the key was lifted to raise the pins clear and allowing the bolt, with the key in it, to be slid back. Four thousand years later, the falling-pin principle remains a basic feature of many locks, including the modern Yale lock.

The Romans introduced metal for locks often bronze for the key. The Romans also invented wards, projections around a keyhole but inside the lock, which prevent a key from being rotated unless slots are cut in the flat face of the key (the "bit") allowing the projections to pass through the slots. For centuries locks depended on wards for security; significant ingenuity was devoted to designing wards and to cutting keys to make locks secure against any but the correct key.

Ornamentation of keys and locks began in the Middle Ages. Great skill and high degrees of workmanship were employed in making metal locks and keys. Exteriors were lavishly decorated. Keys became virtual works of art. The security afforded by the locks and keys, however, remained dependent on warding; that mechanism of the lock developed hardly at all.

In 1778 Robert Barron, in England, patented a double-acting tumbler lock. A tumbler is a lever, or pawl, that falls into a slot in a bolt to prevent movement until it is raised by the key to exactly the correct height above the slot; the key then slides the bolt. The Barron lock had two tumblers. The key had to raise each tumbler by a different amount before the bolts could be shot. This was a significant advance in lock design, and remains the basic principle of all lever locks. In 1784 a remarkable lock also was patented in England by Joseph Bramah. Operating on an entirely different principle, it used a very small light key, yet provided unprecedented security. Bramah's locks are very intricate and constructed by a series of machines to produce parts mechanically. These were among the first machine tools designed for mass production. With the rapidly expanding economy that followed the Industrial Revolution, the demand for locks and keys grew tremendously. The demand for security in the form of lock and keys, and for ornamentation of both, has persisted unabated. Indeed, adding a wide variety of adornments, designs, and identifying symbols to keys has increased in demand, particularly since Linus Yale invented in 1848 a cylinder lock that could be opened by a small, light, easily transportable flat key with a serrated edge. Pins in the cylinder are raised to the proper height by the serrations, making it possible to turn the cylinder. The number of combinations of heights of the pins coupled with a warding effect provide almost unlimited variations. Yale locks and keys are almost universally used for outside doors of buildings and automobile doors.

Recent innovations have employed magnetic forces used in locks that continue to work on the Yale principle. The key has no serrations; instead, it contains a number of small magnets. When the key is inserted into the lock, the magnets repel magnetized spring-loaded pins, raising them in the same way that serrations on a Yale-type key raise them mechanically. When these pins are raised the correct height, the cylinder of the lock is free to rotate in the barrel.

Because keys are so prevalent a security device, a variety of apparatus have been offered for ornamenting the conventional, bland, unattractive key or key head. Jewelers have offered a variety of interchangeable casings or heads for keys. The shape, configuration, dimensions of keys and key blanks are essentially unlimited.

Therefore, a previously unaddressed need exists in the industry for a new, useful and improved system and method for ornamenting a key that is capable of providing not only ornamentation, but interchangeability of keys with ornamental casings in which keys are held. Particularly, there is a significant need for a method and apparatus that provides a configurable ornamental key system for removably installing a casing capable of adding ornamentation to a key.

SUMMARY OF THE INVENTION

Given the conventional solutions for solving the problem of providing an ornamental casing for a key, it would be desirable, and of considerable advantage, to provide a system for ornamenting a variety of keys.

The present invention provides numerous advantages in connection with providing a system for ornamenting a key. At least one advantage of the present invention is that it provides a system capable of interchangeably accepting a variety of keys and key blanks. Another advantage of a configurable key system is the ease with which a number of different keys may be inserted into and removed from the key casing. Yet another advantage of the present invention is a method for removably installing a casing on a key that securely houses a key within the casing, while allowing ease of removal, yet provides a wide variety of ornamental configurations for the system. The present invention also provides an apparatus and method for making the apparatus that respectively are easy to use and to practice, and which are cost effective for their intended purposes. The advantages and other objects of the present invention, and features of such an invention, will become apparent to those skilled in the art when read in conjunction with the accompanying following description, drawing figures, and appended claims.

A system for ornamenting a key includes a casing, a key blank that is removably insertable into the casing, and a number of ways for securing the key blank in the casing. The casing may be shaped or ornamented in a number variety of ways. The casing may be formed to engage a tray in which a portion of the key or key blank may be reposited. For additional rigidity among the structural components of the assembled system for ornamentation of a key, the tray may include a neck engageable with a notch formed in the nonoperative end of the key or key blank. To secure the components of the invention, the tray also may include a threaded tube mounted substantially vertically on the top surface of the tray. The threaded tube protrudes through a hole formed in the key as well as through an opening formed through the casing. One or more threaded rods for removably securing the key blank within the casing may be used such as a nut, bolt, or similar threaded rod for securing the components may be used to hold the system together. Because the securing device is threaded, the key is removable from the casing. Not only may the casing itself be ornamental and ornamented in any way, the securing devices used to secure the components may themselves be ornamented.

In an alternative embodiment, the system for ornamenting a key may provide one or more indentations in the body of the key blank. The casing may be formed with one or more threaded ducts through the collar of the casing. Also, one or more threaded set screws that are retractably insertable may be inserted through the threaded ducts until one end of the threaded set screw is adjacent the one or more indentations, thus securing the casing to the key.

In yet another alternative embodiment of the present invention, the system for ornamenting a key may include one or more tab flanges formed in the collar of the casing. After inserting one end of the key into the casing, the user may apply pressure on the one or more tabs, thus engaging one or more indentations formed in the body of the key blank.

Thus, it is clear from the foregoing that the claimed subject matter as a whole, including the structure of the apparatus, and the cooperation of the elements of the apparatus, as well as the method for the apparatus, combine to result in a number of unexpected advantages and utilities of the present invention as recited above.

The foregoing has outlined broadly the more important features of the invention to better understand the detailed description which follows, and to better understand the contribution of the present invention to the art. Before explaining at least one embodiment of the invention in detail, it is to be understood that the invention is not limited in application to the details of construction, and to the arrangements of the components, provided in the following description or drawing figures. The invention is capable of other embodiments, and of being practiced and carried out in various ways. Also, the phraseology and terminology employed in this disclosure are for purpose of description, and should not be regarded as limiting.

As those skilled in the art will appreciate, the conception on which this disclosure is based readily may be used as a basis for designing other structures, methods, and systems for carrying out the purposes of the present invention. The claims, therefore, include such equivalent constructions to the extent the equivalent constructions do not depart from the spirit and scope of the present invention. Further, the abstract associated with this disclosure is neither intended to define the invention, which is measured by the claims, nor intended to be limiting as to the scope of the invention in any way.

The novel features of this invention, and the invention itself, both as to structure and operation, are best understood from the accompanying drawing, considered in connection with the accompanying description of the drawing, in which similar reference characters refer to similar parts, and in which:

DESCRIPTION OF THE PREFERRED EMBODIMENTS

Briefly, the present invention provides a system and method for ornamenting a key. The system and method for ornamenting a key includes a casing, a key blank or key, and means for securing the key blank in the casing.

Figure 1:
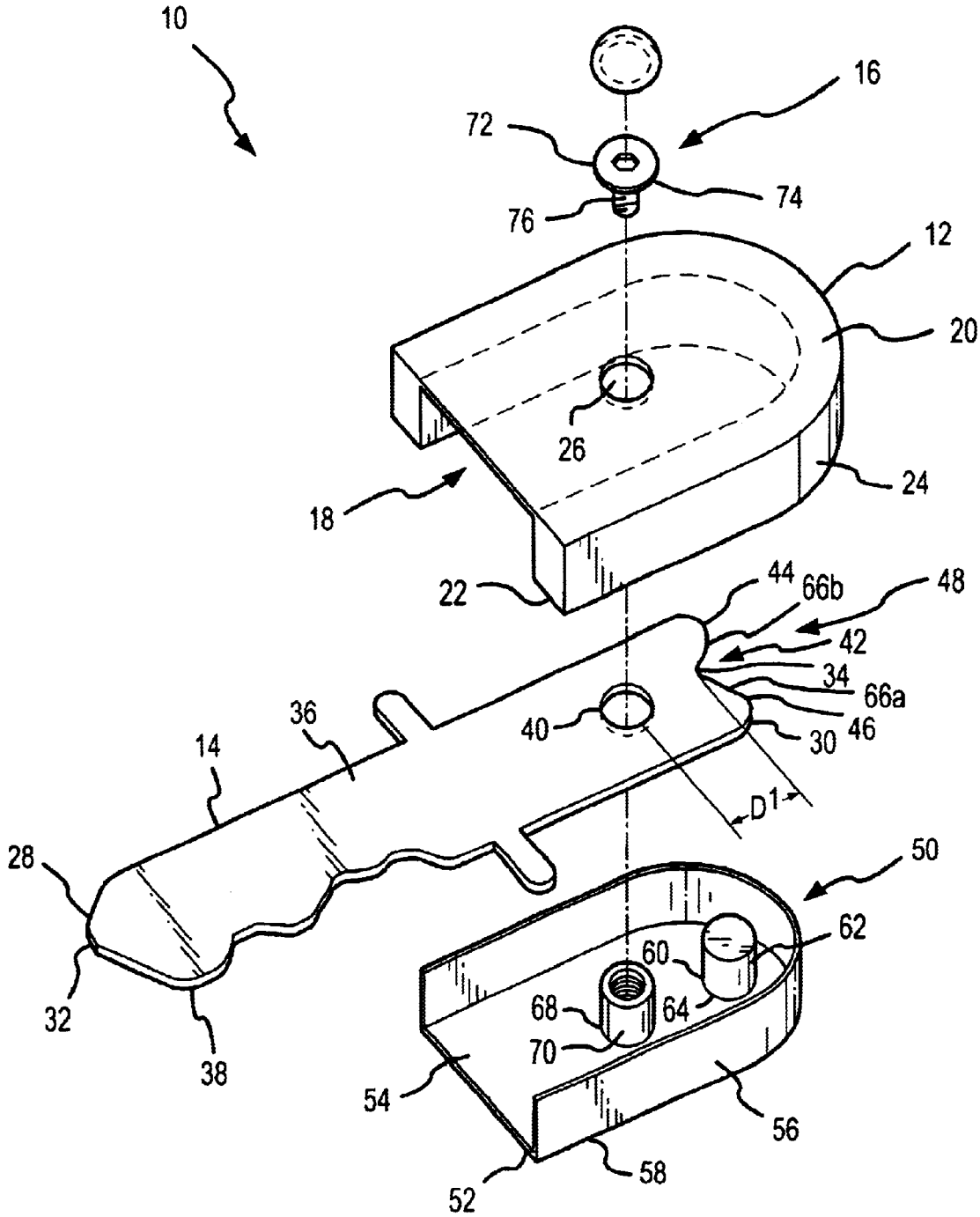
FIG. 1 is an exploded perspective view of the system for ornamenting a key shown in an exploded configuration.

FIG. 1 is a perspective exploded view of one embodiment of the system and method for ornamenting a key having a casing, a key blank, and means for securing the key blank in the casing. Referring initially to FIG. 1, therefore, the system and method for ornamenting a key is shown and generally designated 10. As shown, a system and method for ornamenting a key 10 includes a casing 12. Casing 12 may be formed in any shape or configuration, and of any materials. Also included is a key blank 14. Key blank 14 is removably insertable into casing 12. The present invention also includes means for securing 16 key blank 14 in casing 12.

As also shown in FIG. 1, casing 12 of the present invention is formed with a channel 18. Channel 18 is formed in turn by forming casing 12 with a first plate 20, a second plate 22, and a collar 24 between first plate 20 and second plate 22. Casing 12 also is formed with an opening 26 through first plate 20. The shape of opening 26 is shown in FIG. 1 as substantially circular, but opening 26 also may be formed in substantially triangular, square, or other configurations.

As also shown in FIG. 1, the present invention includes a key blank 14 or key 28. Key 28 is formed with a body 30 having a distal end 32 and a proximal end 34. Body 30 of key 28 also includes a first plane 36 and a second plane 38. In one embodiment of the present invention, a bore 40 is formed through body 30 of key blank 14 between first plane 36 and second plane 38. Bore 40 may be adjacent proximal end 34 of key blank 14 as shown diagrammatically in FIG. 1 as the distance $D^1$. As further shown in FIG. 1, a system for ornamenting a key 10 includes a notch 42 that is formed through body 30 of key blank 14 at proximal end 34 of key blank 28. The size and dimensions of notch 42 are not germane to practicing the present invention. In one embodiment of the present invention, as shown in FIG. 1, notch 42 is substantially triangular in shape, having opposingly formed tapering first side 44 and tapering second side 46 that intersect in a substantially v-shaped groove 48. Distance $D^1$, therefore, according to one embodiment of the present invention, extends, as is shown in FIG. 1, between v-shaped groove 48 and the center of bore 40 through body 30 of key blank 28.

Also shown in FIG. 1 is a tray 50. As shown, tray 50 is positionable in casing 12, and key blank 14 is positionable in tray 50. Tray 50, as shown, includes a bottom surface 52, a top surface 54, and a wall 56 extending substantially vertically from top surface 54 along the peripheral edge 58 of top surface 54 of tray 50. Tray 50 also is formed with a neck 60. Neck 60 as shown in FIG. 1 is a substantially cylindrical column 62 extending from top surface 54 of tray 50. Neck 60 as shown also includes a substantially circumferential face 64. As one skilled in the art will recognize, however, neck 60 may be formed in any shape consistent and compatible with the shape of notch 42 in key blank 14 because neck 60 is formed in tray 50 to be engageable with notch 42. Neck 60 is therefore located on tray 50 so that a portion of circumferential face 64 of neck 60 is engageable with at least one point 66 on each of tapering first side 44 and tapering second side 46 of notch 42 when proximal end 34 of key blank 14 is inserted in tray 50. Engagement of circumferential face 64 of neck 60 with at least one point 66*a,b* on each of tapering first side 44 and tapering second side 46 contributes to securely holding key blank 14, tray 50, and casing 12 tightly but removably together on assembly of the system for ornamenting a key 10. As further shown in FIG. 1, tray 50 also includes a threaded tube 68. Threaded tube 68 is mounted substantially vertically on top surface 54 of tray 50. Threaded tube 68, as shown, is substantially tubular, and is shown with a tubular surface 70. As those skilled in the art will appreciate, however, threaded tube 68 need not be substantially tubular. Threaded tube 68 is positioned on top surface 54 of tray 50 along a longitudinal axis through threaded tube 68 and bore 40 of key blank 28. Threaded tube 68, in a preferred embodiment of the present invention, is shaped to form an interference fit between bore 40 and tubular face 70 when the system of the present invention is assembled.

The present invention also includes, as shown in FIG. 1, removable means for securing 16 casing 12, key blank 28, and tray 50. In a preferred embodiment of the present invention, means for securing 16 is one or more threaded rods 72 for removably securing key blank 14 within casing 12, such as a bevel headed screw 74 shown in FIG. 1. The screw threads 76 of bevel headed screw 74 are dimensioned and formed to be engageable with threaded tube 68 on tray 50 through opening 26 in first plate 20. As a person skilled in the art will appreciate, bevel headed screw 74 may alternatively be a bolt 78 or any of several other means for securing casing 12, key blank 14 and tray 50.

Figure 2:
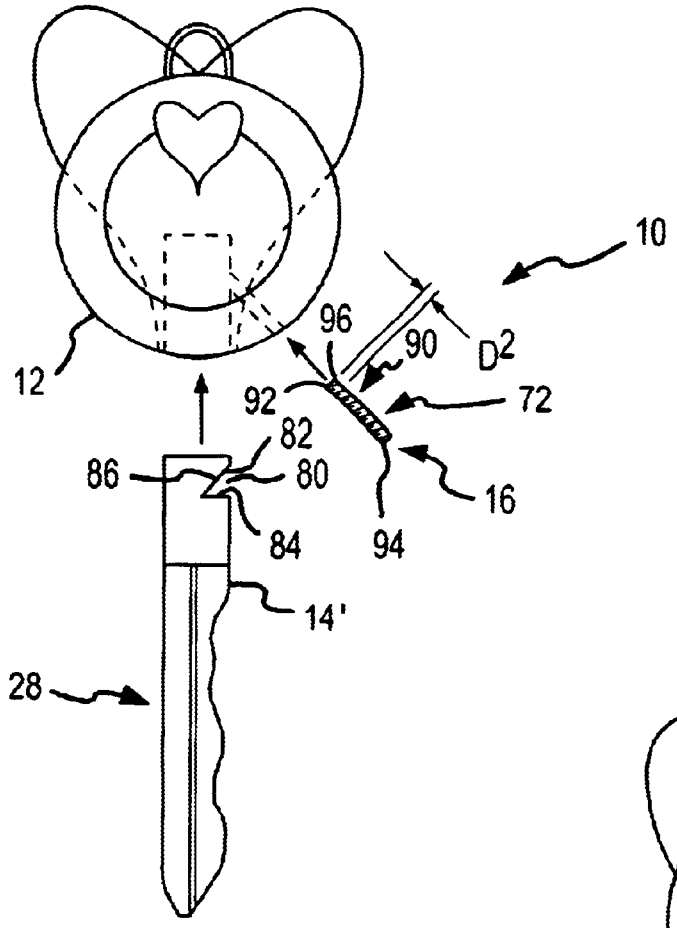
FIG. 2 is a top view of an alternative embodiment of the present invention.
Figure 3:
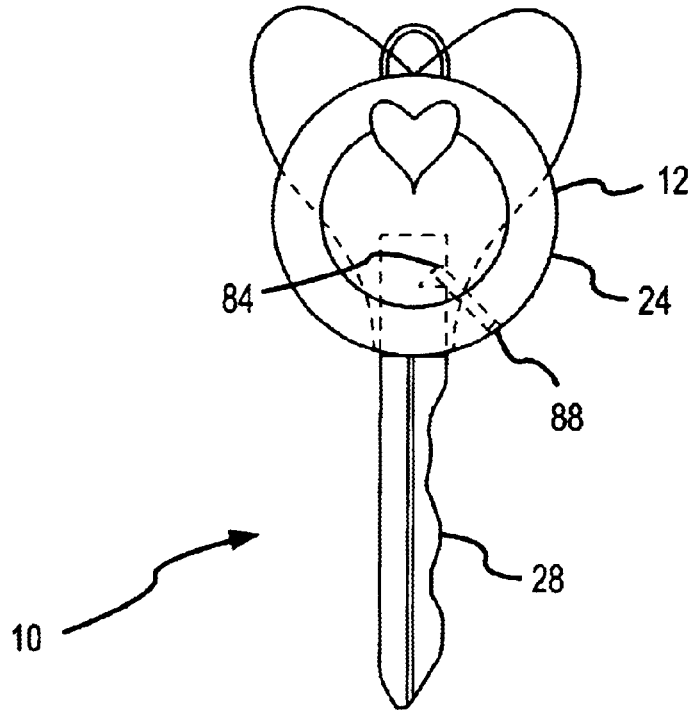
FIG. 3 is a top view of another alternative embodiment of the present invention.

In an alternative embodiment of the present invention, as best shown by reference to FIG. 2, a system for ornamenting a key 10 may include key blank 14' on which one or more indentations 80 is formed in body 30 of key blank 28. As shown, one or more indentations 80 are shown as formed substantially in the shape of a triangular cavity 82 having a first interior surface 84 and a second interior surface 86. As one skilled in the art will appreciate, however, one or more indentations 80 may be shaped in any number of configurations for receiving one end of the one or more threaded rods 72 for removably securing key blank 14 within casing 12 including by way of example, but not of limitation, threaded screws more fully described below. Also provided, as shown in FIG. 3, is a system for ornamenting a key 10 in which casing 12 is formed with one or more threaded ducts 88. One or more threaded ducts 88 extend through collar 24. Further, means to securing 16 is provided by inserting one or more threaded set screws 90 retractably through one or more threaded ducts 88. One or more threaded set screws 90 include a leading end 92 and a trailing end 94. Leading end 92 of threaded set screw 90 provides an unthreaded head portion 96 shown as extending a Distance $D^2$ on FIG. 2. Trailing end 94 of one or more threaded set screws 90 includes, in a preferred embodiment, a Phillips head receptacle (not shown), but as one skilled in the art will appreciate, alternative receptacles may be included. Using a driving means (not shown), one or more threaded set screws 90 may be driven into one or more threaded ducts 88 so that head portion 96 is positioned abutted against one or more indentations 80, or as shown in FIG. 2, tightly against first interior surface 84 to secure key blank 14 in casing 12. As will be evident to one skilled in the art, this alternative embodiment of the present invention may dispense with use of tray 50.

Figure 4A:
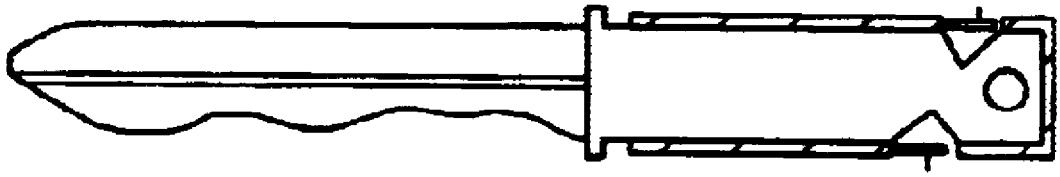
FIG. 4A is a top cut-away view of portions of the present invention.
Figure 4B:
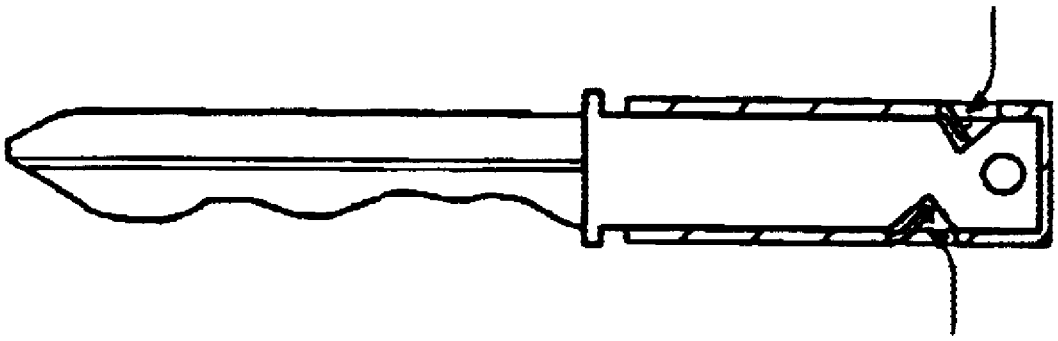
FIG. 4B is a top cut-away view of portions of the present invention.
Figure 5:
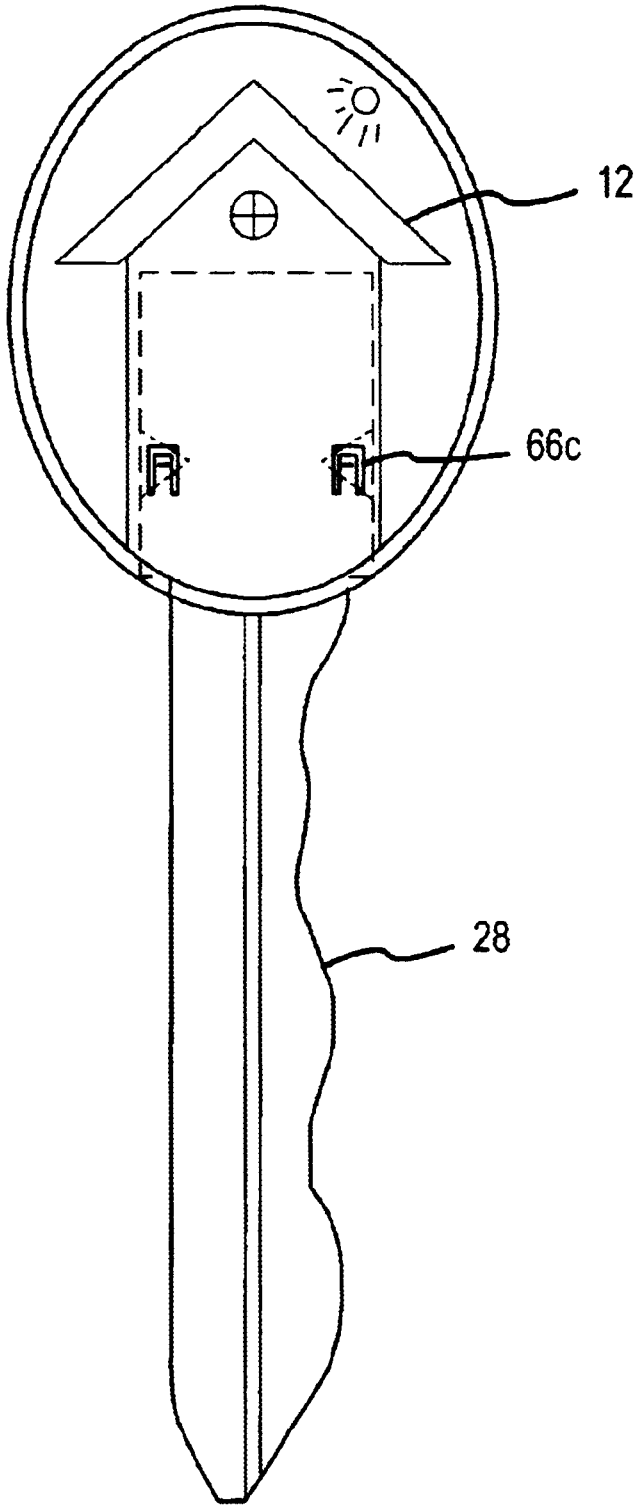
FIG. 5 is a top partial view of an alternative embodiment of the present invention.

In yet another alternative embodiment, as best shown in FIGS. 4 and 5, a system for ornamenting a key 10 is provided wherein one or more tab flanges 98*a,b* are formed in collar 24 of casing 12. For this embodiment, casing 12 would preferably be made of malleable material such as metal. One or more indentations 80' are formed in key blank 14 substantially in the shape of a triangular cavity 82' having a first interior surface 84' and a second interior surface 86'. As one skilled in the art will appreciate, however, one or more indentations 80' may be shaped in any number of configurations. After inserting key blank 14 into casing 12, pressure may be applied against one or more tab flanges 98 formed in collar 24 of casing 12 to engage tab flanges 98 tightly against at least one point 66*c* on first interior surface 84' and second interior surface 86' to secure key blank 28 in casing 12. As will be evident to one skilled in the art, this alternative embodiment of the present invention may dispense with use of tray 50.

Figure 6:
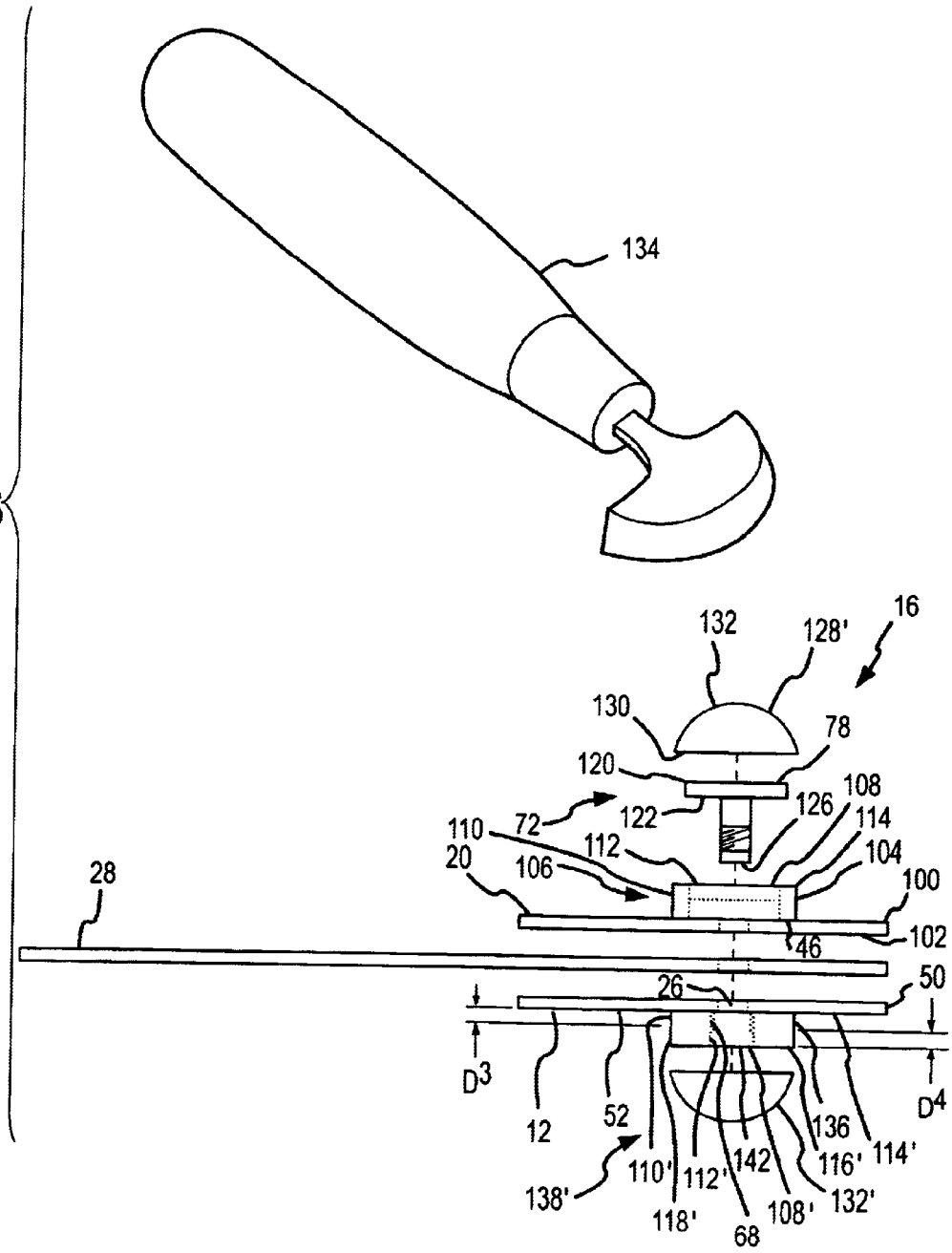
FIG. 6 is a perspective view of a tool used in connection with assembly of the present invention, as well as a side view of an embodiment of the present invention.

Another embodiment of the means for securing 16 key blank 28 in the casing 12 is shown in FIG. 6. As shown, first plate 20 of casing 12 includes an outer side 100 and an interior side 102. An initial crown 104, also known in the field of the invention as a bezel 106, is formed on outer side 100 of first plate 20 of casing 12. In a preferred embodiment of the present invention, initial crown 104 is substantially annular in shape, but as those skilled in the art will appreciate, initial crown 104 may be formed in other than an annular configuration to adapt to the shape of the ornamental member insertable in initial crown 104 as more fully described below. Initial crown 104 is further formed with a passage 108 along the longitudinal axis of initial crown 104, such that initial crown 104 includes an exterior facet 110 and an interior facet 112 that, by way of example but not of limitation, are coincident with the longitudinal axis of initial crown 104. Initial crown 104 also is formed with a forward edge 114 and a rear portion 116. A rim 118 is peripherally mounted inwardly radially from interior facet 112 of initial crown 104. Initial crown 104 is also positioned substantially coincident with the longitudinal axis through both initial crown 104 and opening 26, as shown in FIG. 6. In operation, following assembly of casing 12, key blank 28, and tray 50, one or more threaded rods 72 are insertable through passage 108, past rim 118, and through opening 26 in casing 12. One or more threaded rods 72 may be in the form of a screw or bolt 78' as shown by way of example but not of limitation in FIG. 6. Bolt 78' is shown to be formed with a head 120 having an anterior surface 122 and a posterior surface 124, and a fore end 126 of bolt 78'. Posterior surface 124 is sized and dimensioned to contact rim 118 in interior facet 112 of initial crown 104. In operation, after the means for securing 16 key blank 14 in casing 12 is effected, ornamental member 128, formed with a flat surface 130, shown as a gem stone 128' formed with a substantially hemispherical surface 132 by way of example but not of limitation in FIG. 6, is inserted within the interior facet 112 of passage 108. Any number of tools, including a rocking bezel setting tool 134 as shown in FIG. 6, may be used to apply pressure against exterior facet 110 of initial crown 104 to crimp exterior facet 110 over a portion of hemispherical surface 132 of gem stone 128'.

Means for securing 16 also may include a subsequent crown 136 formed on bottom surface 52 of tray 50. In a preferred embodiment of the present invention, subsequent crown 136 is substantially annular in shape, but as those skilled in the art will appreciate, subsequent crown 136 may be formed in other than an annular configuration to adapt to the shape of second ornamental member 138 insertable in subsequent crown 136 as more fully described below. Subsequent crown 136 is further formed with a passage 108' coincident with the longitudinal axis of subsequent crown 136, such that subsequent crown 136 includes an exterior facet 110' and an interior facet 112' that, by way of example but not of limitation, are coincident with the longitudinal axis of subsequent crown 136. Interior facet 112' of subsequent crown is partially formed with threads 140 as also shown in FIG. 6. Preferably, threads 140 extend within interior facet 112' a Distance $D^3$ within interior facet 112 between the forward edge 114' and rear portion 116' of subsequent crown 136.

In operation, threaded rod 72 which as shown in FIG. 6, is bolt 78', and is inserted through passage 108 in initial crown 104; posterior surface 124 of bolt 78 contacts rim 118; bolt 78' is further extended through bore 40 in key blank 14, and through threaded tube 68 on tray 50; and bolt 78' is sized so that fore end 126 of bolt 78' extends to a depth in threaded tube 68 known as the anchor end 142 as shown in FIG. 6. Subsequent crown 136 also is formed with a forward edge 114' and a rear portion 116'. Subsequent crown 136 is also formed with a rim 118' and is peripherally mounted inwardly radially from interior facet 112 of subsequent crown 136. Subsequent crown 136 is also positioned substantially coincident with the longitudinal axis through both subsequent crown 136 and threaded tube 68, as also shown in FIG. 6. Threads in bolt 78 securely thread with threaded tube 68, leaving a distance $D^4$ as shown in FIG. 6 between fore end 126 of bolt 78 and rear portion 116' of subsequent crown 136. In operation, after means for securing 16 key blank 14 in casing 12 is effected, ornamental member 128, formed with a flat surface 130, shown as a gem stone 128' formed with a substantially hemispherical surface 132 by way of example but not of limitation in FIG. 6, maybe inserted within interior facet 112' of passage 108'. Any number of tools, including a rocking bezel setting tool 134 as shown in FIG. 6, may be used to apply pressure against exterior facet 110' of subsequent crown 136 to crimp exterior facet 110' over a portion of hemispherical surface 132' of gem stone 138'.

While the system for ornamenting a key as shown in drawing FIGS. 1 through 6 provide at least three embodiments of the present invention, the drawing figures are merely three embodiments of the invention, are not intended to be exclusive, and are not limitations of the present invention. The particular system for ornamenting a key as shown and disclosed in detail in this instrument is fully capable of obtaining the objects and providing the advantages stated, but this disclosure is merely illustrative of the presently preferred embodiments of the invention, and no limitations are intended in connection with the details of construction, design or composition other than as provided and described in the appended claims.

What is claimed is:

1. A system for ornamenting a key, comprising:

a casing, wherein the casing is formed with a channel, a first plate formed with an opening through the first plate, a second plate, and a collar therebetween;

a key blank removably insertable into the casing, wherein the key blank is formed with a body having a distal end, a proximal end further formed with a notch, and a bore through the body adjacent the proximal end of the key blank;

a tray positionable in the casing, wherein the tray has a bottom surface, a top surface formed with a neck engageable with the notch of the key blank, a wall extending substantially vertically from the top surface along the peripheral edge of the top surface, and a threaded tube mounted substantially vertically on the top surface; and means for removably securing the key blank in the casing.

2. A system for ornamenting a key as recited in claim 1, wherein the securing means is a bevel headed screw engageable with the tube in the tray through the opening in the first plate.

3. A system for ornamenting a key as recited in claim 1, wherein the securing means further comprises means for mounting an ornamental member on the securing means.

4. A system for ornamenting a key as recited in claim 1, wherein the securing means is a threaded set screw retractably insertable into the threaded tube.

5. A configurable ornamental key system, comprising:

a key blank formed with a proximal end formed with a notch, a distal end, and a body therebetween, wherein a bore is formed through the body;

a casing formed with a first plate formed with an opening, a second plate, a collar therebetween, the casing shaped for receiving at least the proximal end of the key blank, wherein the first plate is formed with a channel;

a tray positionable in the casing, wherein the tray is formed with a bottom surface, a top surface formed with a neck engageable with the notch in the proximal end of the key blank, a wall extending substantially vertically from the top surface, and further comprising a threaded tubular rivet formed with interior threads extending substantially vertically from the top surface for threadable engagement with a bolt;

a bolt for removably securing the key blank within the casing; and means for mounting a decorative member on the bolt.

6. A method for removably installing a casing on a key, which comprises:

providing a key blank formed with a proximal end, a distal end, and a body therebetween;

forming a bore through the body of the key blank adjacent the proximal end of the key blank;

forming a notch through the body of the key blank at the proximal end of the key blank;

disposing a casing over the proximal end of the key blank;

shaping the casing to include a first plate, a second plate, a collar therebetween, an opening through the first plate, and a channel;

furnishing a tray positionable in the casing, the tray formed with a bottom surface, a top surface, and a wall extending substantially vertically from the top surface;

installing on the top surface of the tray a neck engageable with the notch formed at the proximal end of the key blank;

including a tubular rivet formed with interior threads extending substantially vertically from the top surface;

providing a bevel headed screw engageable with the tubular rivet in the tray through the opening in the first plate; and securing the key blank within the casing with the screw.

* * * * *